United States Patent [19]

Hancock

[11] Patent Number: 4,475,724

[45] Date of Patent: Oct. 9, 1984

[54] WIRE SPRING ASSEMBLY FOR SOFA SLEEPER MATTRESSES

[75] Inventor: William L. Hancock, Lexington, Ky.

[73] Assignee: Hoover Universal, Inc., Ann Arbor, Mich.

[21] Appl. No.: 380,189

[22] Filed: May 20, 1982

[51] Int. Cl.[3] ..... F16F 3/00

[52] U.S. Cl. ..... 267/103; 5/247; 5/255; 267/106; 267/110

[58] Field of Search ..... 267/89, 103, 104, 105, 267/106, 107, 108, 109, 110, 111, 112, 131, 146, 85, 91, 92, 93, 95, 96, 97, 101, 102; 5/247, 266, 255, 257, 259, 267–277

[56] References Cited

U.S. PATENT DOCUMENTS 2,291,004 7/1942 Stewart et al. ..... 5/247

2,726,409 12/1955 Bellgran ..... 5/266

*Primary Examiner*—Douglas C. Butler

*Attorney, Agent, or Firm*—Stephenson and Boller

[57] ABSTRACT

A wire spring assembly adaptable for use in a mattress for a sleeper sofa or roll-away bed in which individual wire spring units are secured to each other and arranged in rows that extend transversely of the assembly. Each spring unit has a pair of end portions, a plurality of torsion bars and one or more connecting bars extending between the torsion bars. The end portions are adaptable to be attached to the corresponding end portions of adjacent spring units in the same row. The assembly further includes a plurality of flexible wire members extending longitudinally of the assembly substantially the length thereof, which are secured to the end portions of some of the spring units to position the rows while allowing the mattress to be folded.

8 Claims, 8 Drawing Figures

FIG. 6
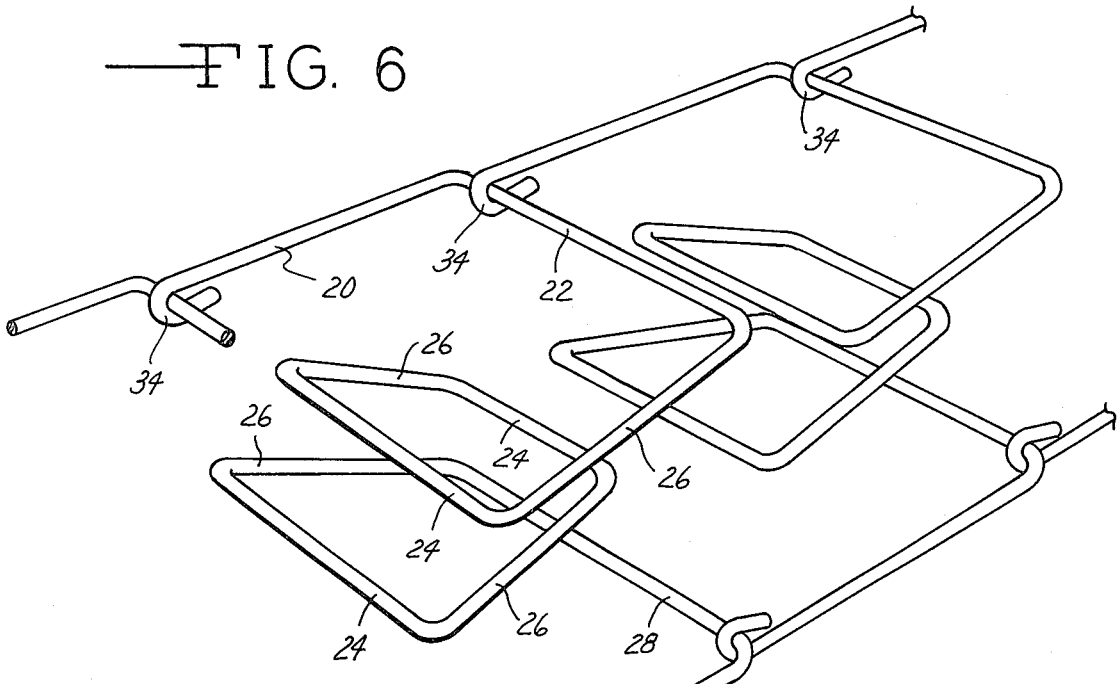
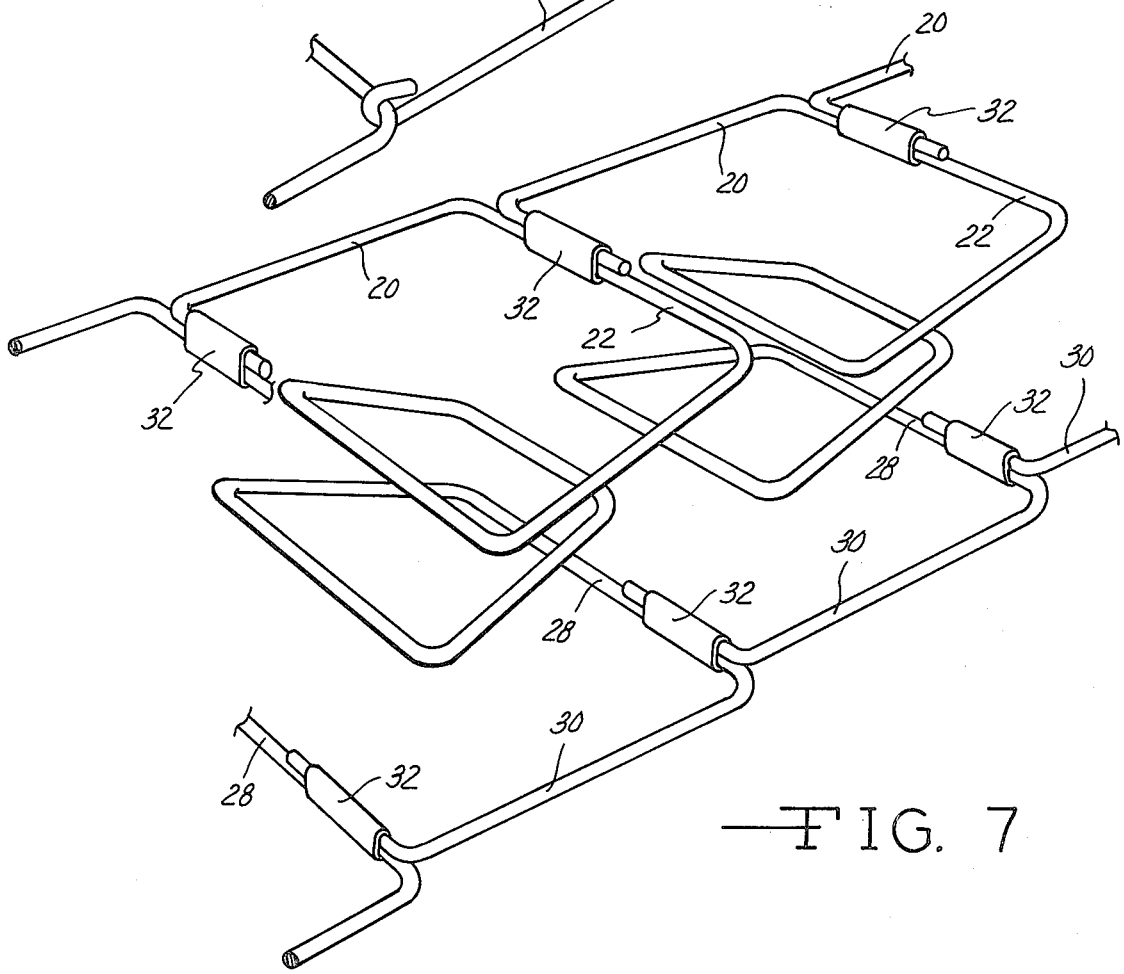
FIG. 7

WIRE SPRING ASSEMBLY FOR SOFA SLEEPER MATTRESSES

BACKGROUND OF THE INVENTION

Mattresses for beds of the type which include inner springs are conventionally equipped with coil springs, which are well-known in the art. The coil springs are typically connected to a pair of independent wire decks, which are formed of elongated wires arranged in a criss-cross fashion. Mattresses of this type have been in use for many years and are generally satisfactory. However, mattresses of this type are somewhat expensive to manufacture becuase they require a large volume of wire. In addition, they are sometimes found to be objectionable from the standpoint of firmness because a load on one portion of the mattress tends to impart undesirable deflection to other parts of the mattress. Furthermore, it is usually found that a large number of wire clips are required to secure the springs to the decks, which adds to the cost as well as to the weight of the assembly. It is an object of the present invention, therefore, to provide a wire spring assembly which minimizes the use of wire and wire clips while increasing the firmness control of the mattress.

There has also been a desire in the industry to incorporate the advantages of wire spring assemblies into mattresses adapted for use in sleeper sofas and roll-away beds. Typical wire spring assemblies employ rigid wires extending both longitudinally and transversely of the mattress, and consequently cannot be folded. Thus, attempts at using wire spring assemblies in sofa sleeper mattresses have been unsatisfactory. As a result, the typical sleeper sofa or roll-away mattress consists merely of foam padding and fabric. This is disadvantageous from the standpoint of user comfort. It is another object of the present invention, therefore, to provide an improved wire spring assembly which is adaptable for use in sleeper sofas and roll-away beds.

SUMMARY OF THE INVENTION

The wire spring assembly of this invention is adapted for use in mattresses, and particularly in mattresses for roll-away beds and sleeper sofas, although it is not limited to these particular uses. The assembly consists of a plurality of resilient wire spring units which are secured to each other and arranged in rows which extend transversely of the assembly. The rows are spaced longitudinally. A plurality of flexible wire members are secured to some of the spring units and extend longitudinally of the assembly substantially the length thereof. The combination of flexible wire members and longitudinally spaced transverse rows of springs enables the mattress to be folded along transverse axes without permanent deformation of the wire spring assembly. The invention thus provides an improved wire spring assembly adaptable for use in sleeper sofas.

Each of the wire spring units comprises a first mounting bar, a first end torsion bar, a plurality of intermediate torsion bars, one or more connecting bars extending between the torsion bars, a second end torsion bar and a second mounting bar. The flexible wire members are secured to the mounting bars. The flexible wire members, the first mounting bars and the first end torsion bars of all of the springs in the assembly combine to form a substantially planar generally rectangular first wire deck. Similarly, other flexible wire members, plus the second mounting bars and the second end torsion bars of all of the springs combine to form a second deck which is substantially parallel to the first deck. The intermediate torsion bars and connecting bars cooperate to yieldably resist movement of one deck toward the other deck, and thereby impart firmness to the mattress. The wire spring assembly therefore provides substantially planar support surfaces without the need for independent wire decks, thus reducing the amount of wire needed to manufacture the assembly.

Within a particular row of spring units, an individual spring, rather than being connected to an independent wire deck as in conventional wire spring assemblies, is supported solely by attachment to adjacent spring units in the same row. In a preferred embodiment, each of the first and second mounting bars terminates in a hooked portion which is adapted to receive the corresponding end torsion bar of an adjacent spring unit. This eliminates the need for clips in supporting spring units on the assembly. Furthermore, since torsion bars are free to rotate within the hooked portion, compression of one spring in response to a load has little or no effect on adjacent springs. The wire spring assembly of this invention is thus advantageous from the standpoint of cost, weight and firmness control.

Further objects, features and advantages of this invention will become apparent, and the invention will be more fully understood, from a consideration of the following description, the accompanying drawings and the appended claims.

BRIEF DESCRIPTION OF THE DRAWINGS

FIG. 6 is a perspective view of a portion of one of the rows of spring units;

FIG. 7 is a perspective view similar to FIG. 6 but showing an alternative embodiment of the invention.

DESCRIPTION OF THE INVENTION

Figure 1:
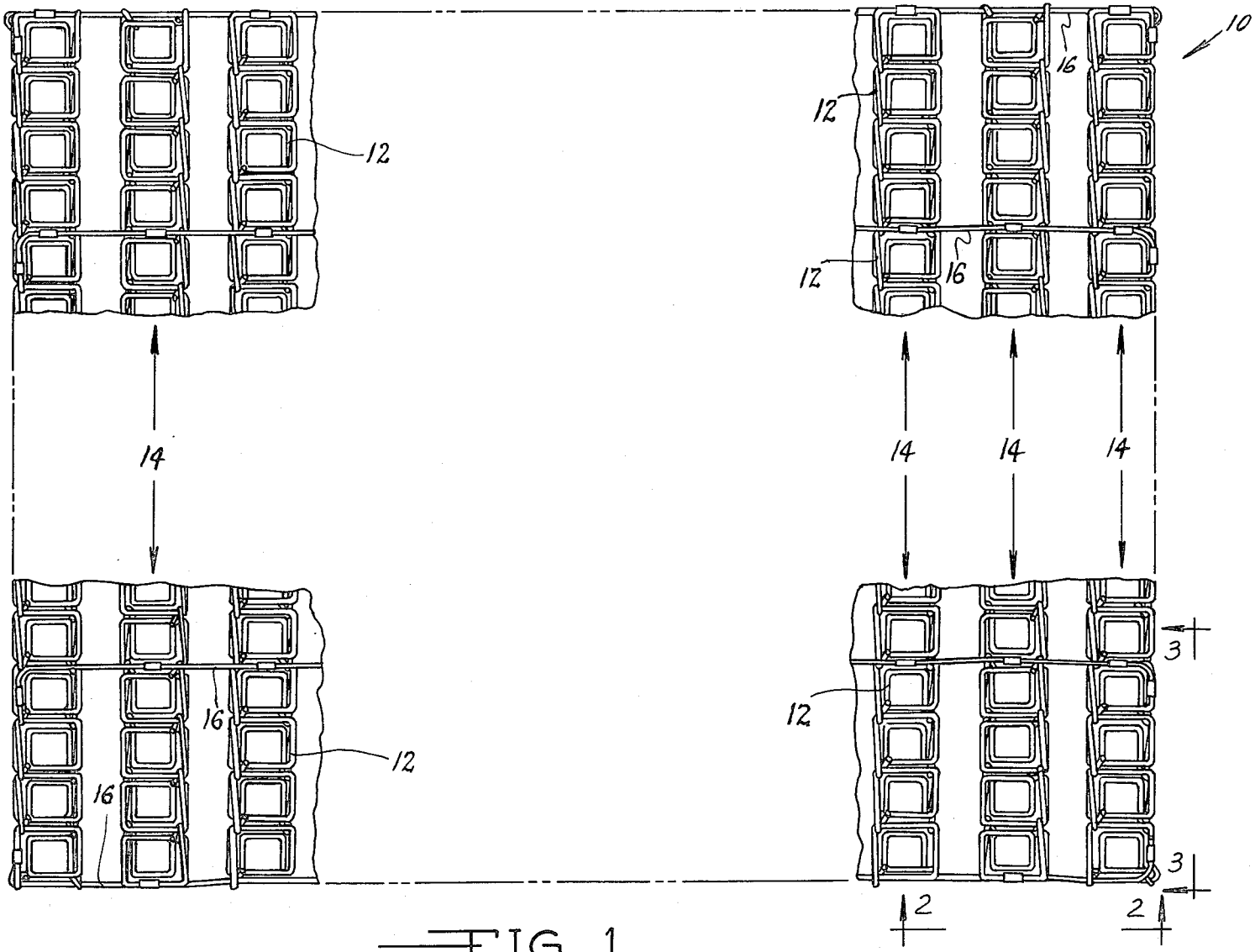
FIG. 1 is a plan view of the wire spring assembly of this invention, illustrating in detail only the corner sections thereof for purposes of clarity.

With reference to the drawings, the wire spring assembly of this invention, indicated generally at 10 in FIG. 1, includes a plurality of formed wire spring units 12 arranged in rows 14. In FIG. 1, the rows 14 are shown extending transversely of the assembly 10; this configuration is advantageous when the assembly 10 is incorporated into a mattress for use in a sofa sleeper or rollaway bed wherein the mattress is folded along transverse axes. However, the spring units 12 can also be arranged in longitudinal rows and, although the invention will hereinafter be described with reference to transverse rows 14, it is to be understood that the invention is not limited to that configuration. The width of the assembly is determined by the number of springs 12 in each row 14, and the length of the assembly is determined by the number of rows 14. Thus, the assembly 10 is readily adaptable for use in mattresses of various lengths and widths by adding or subtracting springs 12 and rows 14.

The assembly 10 further includes a plurality of elongated wire members 16 which extend perpendicular to the rows 14, that is, in the embodiment shown, longitudinaly of the assembly 10. Each wire member 16 is secured to some of the spring units 12 at various points along its length. Wire members 16 are positioned at the ends of the rows 14 and at intermediate positions therebetween. The wire members 16 are located to maintain the rows 14 in desired positions and limit relative movement thereof. Each wire member 16 is formed of a flexible material so that it can be bent but not permanently deformed in response to folding of the assembly 10.

As seen in FIG. 6, each spring unit 12 comprises a first mounting bar 20, a first end torsion bar 22, a plurality of intermediate torsion bars 24, a plurality of connecting bars 26 extending between the torsion bars 24, a second end torsion bar 28 and a second mounting bar 30. As seen in FIGS. 2–5, the flexible wire members 16 are secured to the first and second mounting bars of some of the spring units 12. The wire members 16 are arranged in vertically aligned pairs, hereinafter referred to as "upper" wire members 16 and "lower" wire members 16. The first mounting bar 20 and the first end torsion bars 22 of all of the springs in the assembly 10, in combination with all of the upper wire members 16, form a first wire deck which is substantially planar and generally rectangular. Similarly, the second mounting bars 30 and the second end torsion bars 28 of all of the springs in the assembly 10, in combination with all of the lower wire members 16, form a second wire deck which is substantially parallel to the first deck. The two decks are maintained in a spaced relation by interposition of the intermediate torsion bars 24 and the connecting bars 26, which yieldably resist movement of one deck toward the other deck in response to a load on one of the decks. The invention thus provides a wire spring assembly with a pair of substantially flat support surfaces which are composed principally of portions of the springs themselves, thus obviating the need for independent wire decks which would add to the cost and weight of the assembly.

Figure 2:
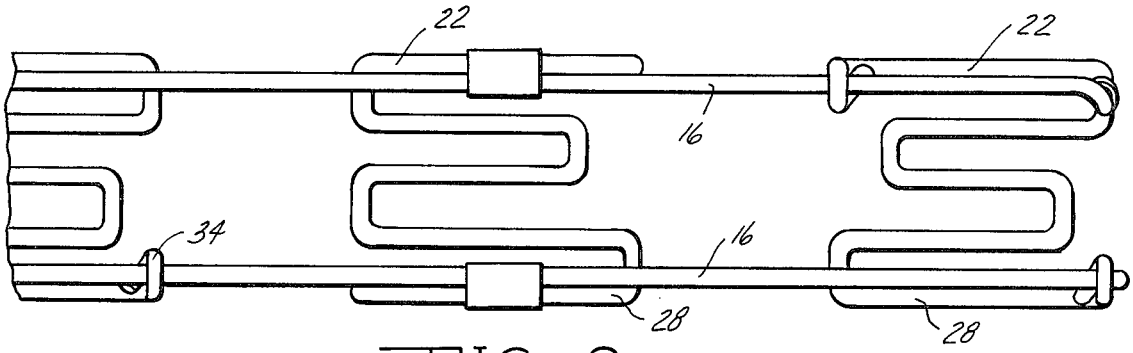
FIG. 2 is a fragmentary longitudinal sectional view of the wire spring assembly of this invention as seen from substantially the line 2—2 in FIG. 1.
Figure 3:
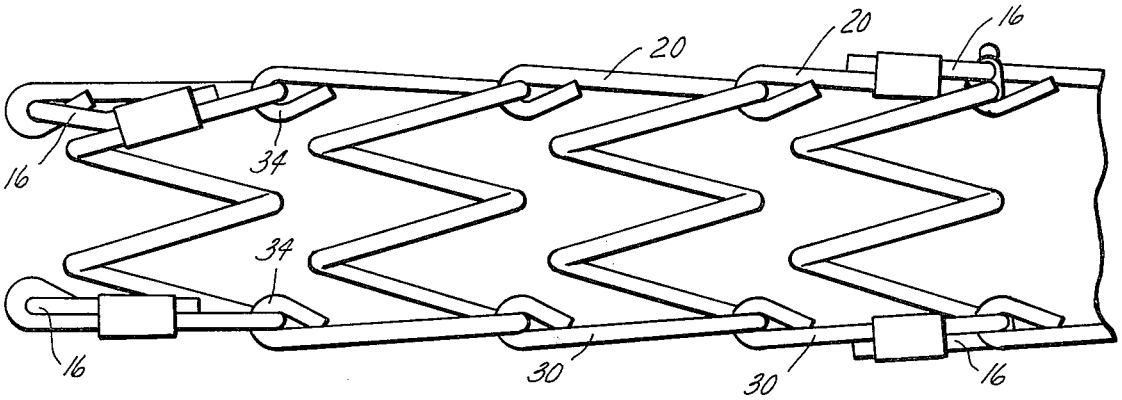
FIG. 3 is a fragmentary transverse sectional view of the wire spring assembly as seen from substantially the line 3—3 in FIG. 1.
Figure 4:
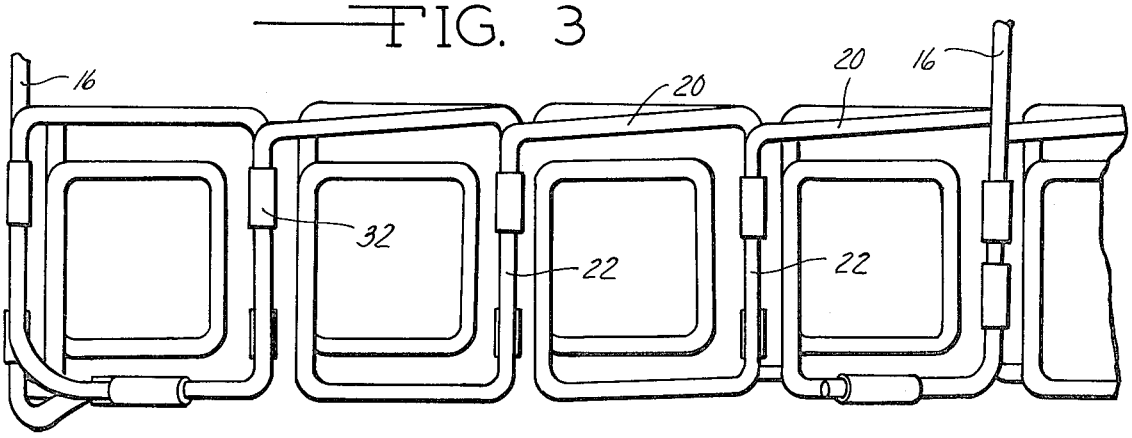
FIG. 4 is a top view of a portion of one of the rows of spring units of the wire spring assembly.
Figure 5:
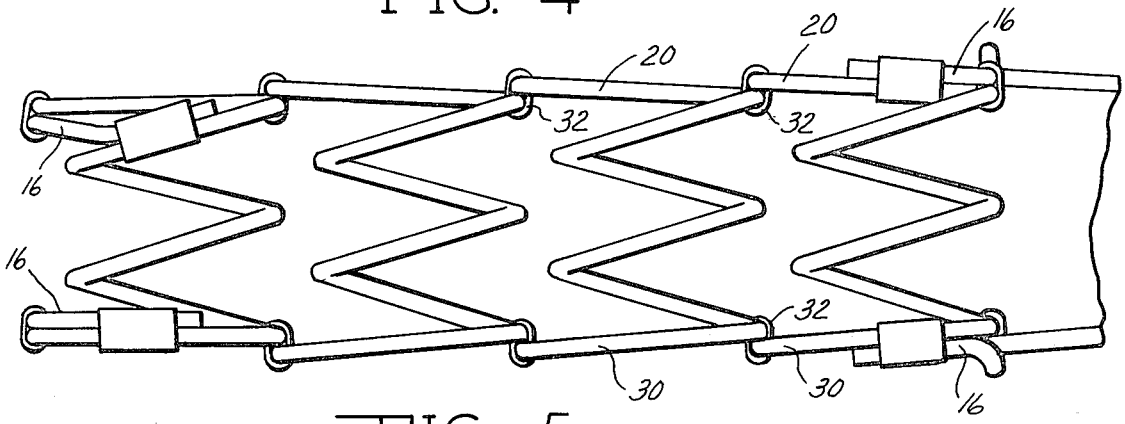
FIG. 5 is a transverse sectional view similar to FIG. 3 but showing an alternative embodiment of the wire spring assembly.
Figure 8:
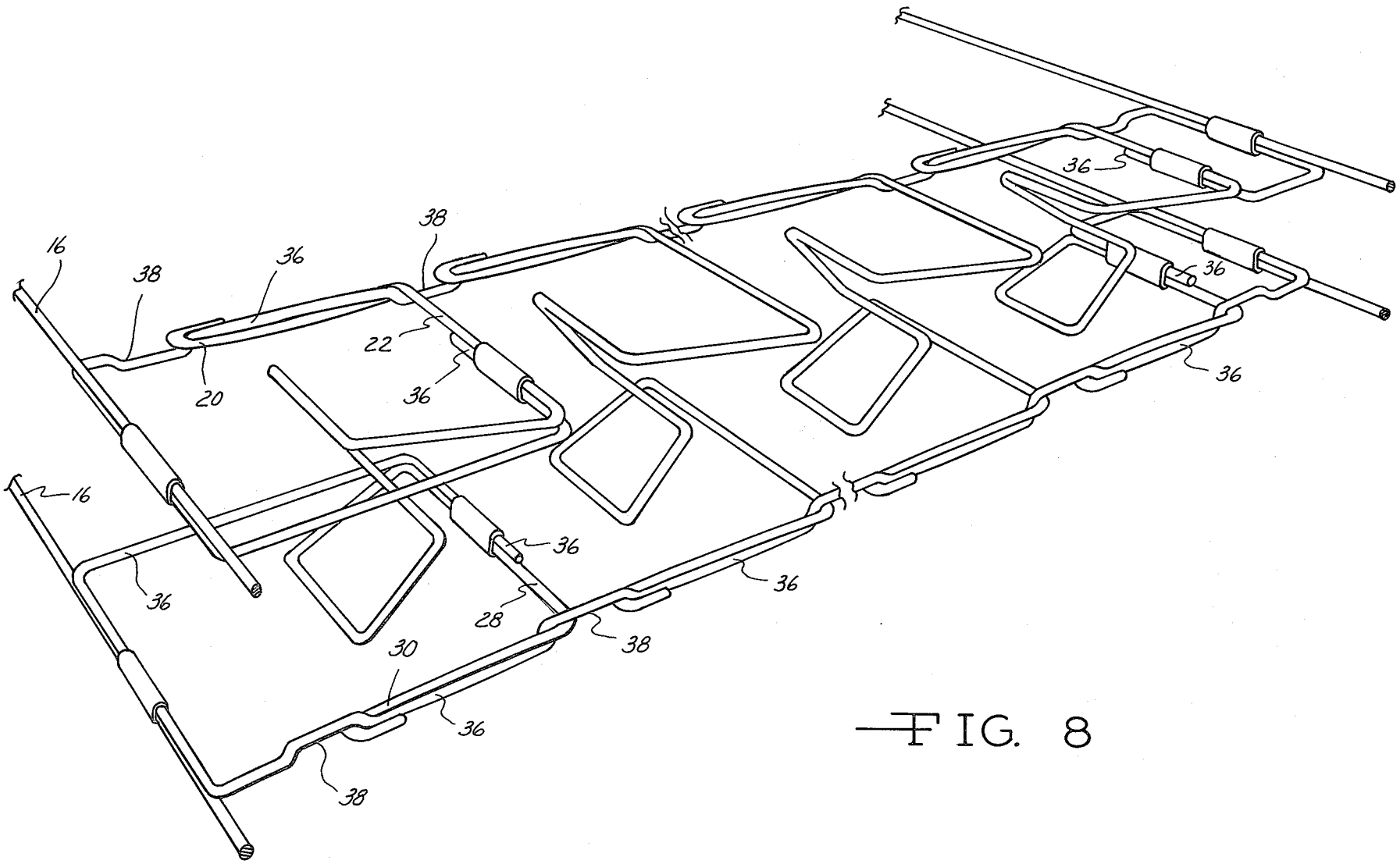
FIG. 8 is a foreshortened perspective view of a row of spring units, showing an alternative embodiment of the wire spring assembly of this invention.

Within any single row 14, the spring units 12 can be connected together in several ways. For example, as seen in FIGS. 4, 5 and 7, the mounting bars 20 and 30 of a particular spring unit 12 may be secured to the first and second end torsion bars 22 and 28 respectively of an adjacent spring unit 12 by means of wire clips 32. In a preferred embodiment, as seen in FIGS. 2, 3, and 6, each of the mounting bars 20 and 30 terminates in a hooked portion 34 which is adapted to receive the end torsion bar 22 or 28 of the adjacent spring unit 12. This embodiment is preferable from the standpoint of cost and weight, since it substantially reduces the number of wire clips 32 required to form the assembly 10. In a third embodiment, as seen in FIG. 8, a pair of independent frame members 36 are provided in each row 14 extending the length thereof. The first mounting bar 20 of each of the springs 12 in the row 14 is secured to one of the frame members 36 while the second mounting bar 30 of each of the springs 12 within the row 14 is secured to the other frame member 36. This may be done, for example, by providing indentations 38 along the frame members 36 and clamping the mounting bars 20 and 30 in an over and under relationship into engagement with the indented areas 38. In each of these embodiments, spring units 12 are held together and maintained within the assembly 10 solely by connection to other spring units, rather than by connection to independent wire decks as in conventional wire spring assemblies.

The invention thus provides an improved wire spring assembly 10 adaptable for use in mattresses for beds, sleeper sofas and roll-away beds. The assembly 10 comprises a plurality of spring units 12 arranged in rows 14 in which individual spring units are connected to each other rather than to an independent wire deck. This reduces the amount of wire needed to form the assembly 10 with a consequent reduction in cost and weight. Improved hook means 34 are also provided on individual springs 12 in order to connect spring units within rows without the use of wire clips. This further reduces the cost and weight of the assembly 10. The assembly 10 further includes improved longitudinal wire members 16 which are formed of flexible rather than rigid material. The flexibility of the wire member 16, combined with the arrangement of springs 12 in transverse rows, allows the assembly 10 to be folded along transverse axes, making it adaptable for use in mattresses for sleeper sofas and roll-away beds.

What is claimed is:

1. A wire spring assembly comprising a plurality of resilient wire spring units, each of said wire spring units comprising a unitary wire member shaped to form a pair of end mounting portions, a plurality of torsion bars between said mounting end portions including end torsion bars adjacent said mounting end portions, and connecting bars extending between said torsion bars, said spring units being arranged in rows wherein each of said spring units is supported solely by attachment of the end mounting portions and the end torsion bars thereof to the corresponding end torsion bars and end mounting portions, respectively, of adjacent spring units in the same row.

2. The wire spring assembly according to claim 1 further including clip means securing said mounting end portions in each unit to the end torsion bars of the adjacent spring unit.

3. The wire spring assembly according to claim 1 wherein each of said mounting end portions terminates in a hooked portion operable to receive an end torsion bar of the adjacent spring unit.

4. A wire spring assembly comprising a plurality of resilient wire spring units arranged in rows extending transversely of said assembly, each of said spring units comprising a unitary wire member formed to include a first end portion, a second end portion which is substantially parallel to said first end portion, a plurality of torsion bars between said end portions and connecting bars extending between said torsion bars, and a plurality of elongated wire members extending longitudinally of said assembly substantially the length of said assembly, said wire members being secured to the end portions of some of said spring units so that said wire members and all of said spring unit end portions cooperate to form a pair of substantially parallel generally rectangular wire decks, said spring units being operable to yieldably resist movement of one of said decks toward the other deck.

5. The wire spring assembly according to claim 4, wherein some of said elongated wire members are positioned at the ends of said transverse rows of spring units.

6. The wire spring assembly according to claim 4 wherein said elongated wire members are formed of flexible material.

7. The wire spring assembly according to claim 4 wherein each of said spring units is supported within a row of springs solely by attachment of its end portions to the corresponding end portions of an adjacent spring unit in the same row.

8. The wire spring assembly according to claim 4 wherein each of said rows of springs include first and second substantially parallel frame members extending substantially the width of the assembly, said spring unit first end portions being attachable to said first frame member and said spring unit second end portions being attachable to said second frame member.

* * * * *